US007865123B2

(12) United States Patent
Jang et al.

(10) Patent No.: US 7,865,123 B2
(45) Date of Patent: Jan. 4, 2011

(54) DEVELOPING DEVICE, WASTE TONER COLLECTING DEVICE AND IMAGE FORMING APPARATUS HAVING THE SAME

(75) Inventors: Myoung Sub Jang, Suwon-si (KR); Kwoang Joe Seorl, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 255 days.

(21) Appl. No.: 12/109,480

(22) Filed: Apr. 25, 2008

(65) Prior Publication Data

US 2009/0010694 A1 Jan. 8, 2009

(30) Foreign Application Priority Data

Jul. 2, 2007 (KR) ..... 10-2007-0066091

(51) Int. Cl.
*G03G 21/12* (2006.01)
*G03G 15/04* (2006.01)

(52) U.S. Cl. ..... 399/360; 399/119

(58) Field of Classification Search ..... 399/35, 399/101, 119, 120, 123, 360
See application file for complete search history.

(56) References Cited

U.S. PATENT DOCUMENTS 4,849,791 A * 7/1989 Hagihara et al. ..... 399/360
6,813,469 B2 * 11/2004 Park ..... 399/360
6,819,885 B2 * 11/2004 Serizawa ..... 399/35
6,937,839 B2 * 8/2005 Harumoto et al. ..... 399/360
7,272,329 B2 * 9/2007 Kang ..... 399/13
7,542,700 B2 * 6/2009 Kim et al. ..... 399/111
7,542,714 B2 * 6/2009 Kim et al. ..... 399/358

FOREIGN PATENT DOCUMENTS

JP 05257340 A * 10/1993
JP 5-313423 11/1993
KR 2005-40973 5/2005

OTHER PUBLICATIONS

Office Action issued by Korean Patent Office in Korean Patent Application No. 2007-66091 on Jun. 19, 2008.
Decision on Grant issued Aug. 28, 2009, in corresponding Russian Application No. 2008119298.
Office Action issued in corresponding Korean Patent Application No. 2007-66091 dated Nov. 28, 2008.

* cited by examiner

*Primary Examiner*—Robert Beatty
(74) *Attorney, Agent, or Firm*—Staas & Halsey LLP

(57) ABSTRACT

An image forming apparatus includes a photosensitive medium on which an electrostatic latent image is formed, an exposure unit to irradiate light onto the photosensitive medium, a developing device to apply toner to the photosensitive medium having the electrostatic latent image formed thereon, a cleaning device to remove waste toner remaining in the photosensitive medium, and a waste toner collecting device to store the waste toner removed from the photosensitive medium. The waste toner collecting device is provided with a supporting rail to support the developing device. The waste toner collecting device includes the supporting rail that supports the developing device, so that additional components to support the developing device are not needed, and the whole size of the image forming apparatus is reduced.

27 Claims, 8 Drawing Sheets

DEVELOPING DEVICE, WASTE TONER COLLECTING DEVICE AND IMAGE FORMING APPARATUS HAVING THE SAME

CROSS-REFERENCE TO RELATED APPLICATION

This application claims the benefit of Korean Patent Application No. 2007-66091, filed in the Korean Intellectual Property Office on Jul. 2, 2007, the disclosure of which is incorporated herein by reference.

BACKGROUND OF THE INVENTION

1. Field of the Invention

Aspects of the present invention relate to an image forming apparatus, and, more particularly, to a waste toner collecting device, capable of collecting a remaining waste toner after forming a visible image, and an image forming apparatus having the same.

2. Description of the Related Art

An image forming apparatus generally develops a black-and-white image or a color image onto a printable medium, such as paper, transparent film, and the like, according to an image signal. Image forming apparatuses include a laser printer, an inkjet printer, a copier, a multifunctional device and a facsimile machine. Such image forming apparatuses may form images through an electrophotography method and an inkjet method. According to the electrophotography method, a beam is irradiated onto a photosensitive medium so as to form an electrostatic latent image, and toner is applied to the electrostatic latent image so as to transfer the image onto the printable medium. According to the inkjet method, ink having a liquid phase is sprayed upon the surface of the printable medium according to the image signal.

The image forming apparatus employing the electrophotography method charges the surface of the photosensitive medium with predetermined potential, irradiates the beam onto the photosensitive medium so as to form the electrostatic latent image according to a potential difference and then applies the toner, which is a developing agent, to the electrostatic latent image so as to form the visible image. The visible image formed on the photosensitive medium is transferred onto the printable medium. The visible image, which is made from a powder toner, is fused to the surface of the printable medium by applying heat and pressure to the printable medium.

The image forming apparatuses employing the electrophotography method are mainly classified into a black-and-white image forming apparatus, which forms the visible image using a monochromatic color (black), and a color image forming apparatus, which forms a color visible image through the combination of toners having four colors (yellow, magenta, cyan and black). Most black-and-white image forming apparatuses directly transfer the visible image formed on the surface of the photosensitive medium onto the printable medium. The color image forming apparatus can directly transfer each color of the toners onto the printable medium, or can indirectly transfer each color of the toners onto the printable medium after overlapping the toners having various colors on an intermediate transfer body.

The image forming apparatus employing the electrophotography method includes a cleaning device and a waste toner collecting device. The cleaning device removes a waste toner remaining in the photosensitive medium or the intermediate transfer body to which the toner is applied. The waste toner collecting device stores the waste toner removed by the cleaning device.

Korean Unexamined Patent Publication No. 10-2005-0040973 discloses a color image forming apparatus having such a waste toner collecting device. According to the above patent Publication, the color image forming apparatus comprises one photosensitive medium on which an electrostatic latent image is formed, four developing devices applying toners having different colors (black, cyan, magenta and yellow) on the photosensitive medium so as to develop the electrostatic latent image formed on the photosensitive medium, an intermediate transfer belt to overlap visible images having various colors formed on the photosensitive medium, a cleaning device to remove a waste toner remaining in the photosensitive medium and the intermediate transfer belt, and a waste toner collecting device to store the waste toner removed by the cleaning device. When printing is being performed, the waste toner remaining in the photosensitive medium and the intermediate transfer belt is removed by the cleaning device, and transferred to the waste toner collecting device by a waste toner transfer device. The waste toner collecting device is installed at one side of an inner body part of the image forming apparatus.

The conventional image forming apparatus includes the waste toner collecting device, increasing the size of the image forming apparatus. Recently, the size of the image forming apparatus is being reduced. However, if the size of the components as well as the waste toner collecting device is reduced, the functionality of the components becomes degraded. For example, if the size of the waste toner collecting device is reduced, the capacity for storing the waste toner becomes reduced so that the waste toner collecting device must be frequently cleaned.

Accordingly, in order to reduce the size of the image forming apparatus without reducing the size of the components as well as the waste toner collecting device, the number of the components and the space for installing the components should be reduced by improving the structure of the components such that one component performs multiple functions.

SUMMARY OF THE INVENTION

Aspects of the present invention provide a waste toner collecting device having an additional function of supporting a developing device as well as collecting a waste toner, such that the number of components in a body of an image forming apparatus can be reduced, and an image forming apparatus having the same.

In addition, aspects of the present invention improve a structure for mounting a developing device such that the size of an image forming apparatus can be reduced.

According to an aspect of the present invention, an image forming apparatus is provided. The image forming apparatus comprises a photosensitive medium on which an electrostatic latent image is formed, an exposure unit to irradiate light onto the photosensitive medium, a developing device to apply a toner to the photosensitive medium having the electrostatic latent image formed thereon, a cleaning device to remove a waste toner remaining in the photosensitive medium, and a waste toner collecting device to store a waste toner removed from the photosensitive medium and having a supporting rail to support the developing device.

According to another aspect of the present invention, the image forming apparatus further comprises a body that forms an outer appearance of the image forming apparatus; wherein an installing space is provided at a first inner side of the body and the waste toner collecting device is detachably installed at the installing space.

According to another aspect of the present invention, the image forming apparatus further comprises a mounting rail provided at a second inner side of the body to support the developing device; wherein each side of each developing device is supported by one of the supporting rails or one of the mounting rails.

According to another aspect of the present invention, the image forming apparatus further comprises an inserting groove provided in the body, into which a front end part of the developing device is inserted; wherein the front end part of the developing device is not separated from the inserting groove even if the waste toner collecting device is separated from the installing space, and one side of the developing device is supported by the mounting rail such that the developing device maintains in a fixed position.

According to another aspect of the present invention, the image forming apparatus further comprises a coupling groove provided at an inner side surface of the body or provided at a side surface of the waste toner collecting device, and a coupling protrusion inserted into the coupling groove and provided at the other of the body and the side surface to fix the waste toner collecting device to a predetermined position of the installing space.

According to another aspect of the present invention, the image forming apparatus further comprises a spacer protrusion protruding from the waste toner collecting device or from the body to separate the waste toner collecting device from the body.

According to another aspect of the present invention, the image forming apparatus further comprises a position fixing groove provided at the supporting rail or provided at the developing device, and a position fixing protrusion inserted into the position fixing groove provided at the other of the supporting rail and the developing device to fix the developing device to a predetermined position of a body of the image forming apparatus.

According to another aspect of the present invention, the waste toner collecting device comprises a waste toner inlet into which the waste toner is input, and a protection cap to open and close the waste toner inlet.

According to another aspect of the present invention, the waste toner collecting device comprises a cap receiving groove to accommodate the protection cap.

According to another aspect of the present invention, an image forming apparatus is provided. The image forming apparatus comprises a photosensitive medium on which an electrostatic latent image is formed, an exposure unit to irradiate light onto the photosensitive medium, a plurality of developing devices to apply a toner to the photosensitive medium having the electrostatic latent image formed thereon, an intermediate transfer body to transfer the visible images to a printable medium, a cleaning device to remove a waste toner remaining in the intermediate transfer body, and a waste toner collecting device to store the waste toner removed from the intermediate transfer body and having a plurality of supporting rails to support the developing devices.

According to another aspect of the present invention, at least one of the supporting rails is inclined.

According to another aspect of the present invention, a waste toner collecting device detachably installed in a body of an image forming apparatus where a developing device storing a toner is installed is provided. The waste toner collecting device comprises a waste toner reservoir to collect the waste toner and a supporting rail to support the developing device.

According to the present invention, the waste toner collecting device, which is detachable to the body of the image forming apparatus, stores the waste toner generated from the main body of the image forming apparatus. The waste toner collecting device comprises the supporting rail that supports the developing device, so that components installed at one side of the main body of the image forming apparatus to support the developing device, can be omitted. Accordingly, the installing space in the main body of the image forming apparatus can be reduced, so that the whole size of the image forming apparatus can be reduced.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
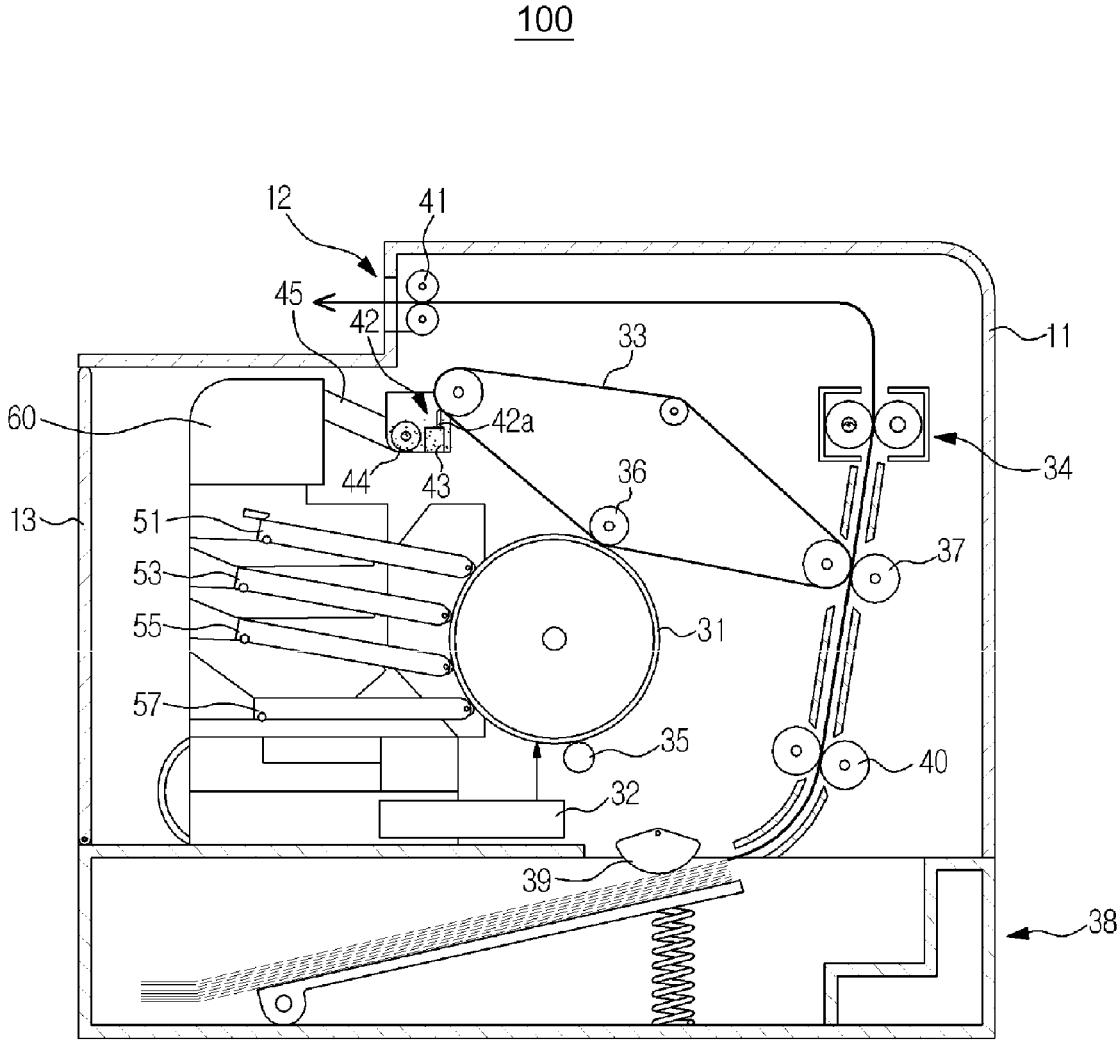
FIG. 1 is a schematic side sectional view showing an image forming apparatus according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

As shown in FIG. 1, an image forming apparatus 100 according to an embodiment of the present invention may be an indirect type color image forming apparatus comprising one photosensitive medium 31 and an intermediate transfer body 33 that overlaps visible images having four colors (black, cyan, magenta and yellow), which are formed on the photosensitive medium 31, and transfers the visible image to a printable medium. The image forming apparatus 100 comprises a body 11 which forms the outer appearance of the image forming apparatus, one photosensitive medium 31 on which an electrostatic latent image is formed, an exposure unit 32, four developing devices 51, 53, 55, and 57, an intermediate transfer body 33, a fusing unit 34, a cleaning device 42, and a waste toner collecting device 60. According to other aspects of the present invention, the image forming apparatus 100 may include additional and/or different units. Similarly, the functionality of one or more of the above units may be integrated into a single component.

The exposure unit 32 forms the electrostatic latent image by irradiating a beam onto the photosensitive medium 31 according to an image signal. The four developing devices 51, 53, 55 and 57 form the visible image having four colors by applying toners having four different colors (black, cyan, magenta and yellow) to the photosensitive medium 31. The intermediate transfer body 33 transfers the visible image from the photosensitive medium 31 to the printable medium. The fusing unit 34 fuses the visible image to the printable medium by applying heat and pressure to the printable medium. The cleaning device 42 removes a waste toner remaining in the intermediate transfer body 33. The waste toner collecting device 60 stores the waste toner removed from the intermediate transfer body 33.

In addition, the body 11 comprises a charging device 35 which charges the photosensitive medium 31 with predetermined potential, a first transfer device 36, a second transfer device 37, a printable medium supplier 38, a pickup device 39, a feed roller 40, and a discharging roller 41. The first transfer device 36 transfers the visible image of the photosensitive medium 31 onto the intermediate transfer body 33. The second transfer device 37 transfers the visible image of the intermediate transfer body 33 onto the printable medium. The printable medium supplier 38 supplies the printable medium. The pickup device 39 picks up the printable medium accumulated on the printable medium supplier 38. The feed roller 40 transfers the printable medium to a transfer position. The discharging roller 41 discharges the printable medium to a discharging unit 12 after the printing is completed.

When a printing command is input, the exposure unit 32 irradiates the beam onto the photosensitive medium 31, which is charged with the predetermined potential by the charging device 35, according to the image signal, thereby forming the electrostatic latent image corresponding to a yellow image on a surface of the photosensitive medium 31. When the photosensitive medium 31 having the electrostatic latent image rotates in the clockwise direction such that the surface of the photosensitive medium 31 having the electrostatic latent image approaches the yellow developing device 51, a yellow toner of the yellow developing device 51 adheres to the electrostatic latent image, thereby forming a yellow visible image on the photosensitive medium 31. The yellow visible image on the photosensitive medium 31 is transferred onto the intermediate transfer body 33 moving in the counterclockwise direction by the first transfer device 36.

Such processes of forming and transferring the visible image are also applicable for the magenta developing device 53, the cyan developing device 55 and the black developing device 57 in the same manner, so that a color image obtained by overlapping the visible images having four colors is formed on the intermediate transfer body 33. In addition, the color image formed on the intermediate transfer body 33 is transferred onto the printable medium by the second transfer device 37, and then the color image is fused to the printable medium when the printable medium passes through the fusing unit 34.

In the image forming apparatus 100, the printable operation is similar to that of a conventional indirect type color image forming apparatus, and the components thereof are also similar to those of the conventional image forming apparatus except for the waste toner collecting device 60 and components structurally/functionally connected to the waste toner collecting device 60. Accordingly, the following description will be focused on the waste toner collecting device 60 and the components structurally/functionally connected to the waste toner collecting device 60.

Figure 2:
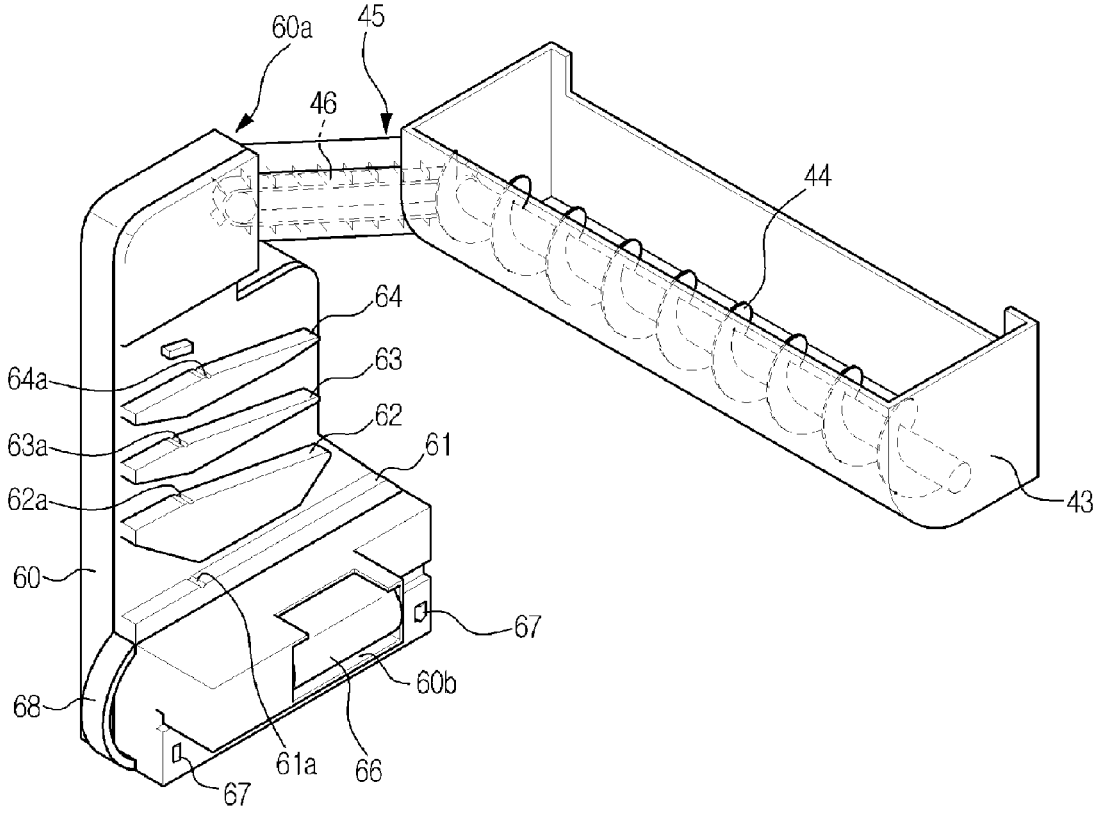
FIG. 2 is a perspective view showing a waste toner collecting device and a component transferring a waste toner to the waste toner collecting device of an image forming apparatus according to an embodiment of the present invention.

The waste toner collecting device 60 is detachably installed in the body 11 to store the waste toner removed from the intermediate transfer body 33. As shown in FIGS. 1 and 2, the waste toner remaining in the intermediate transfer body 33 is removed by the cleaning device 42, and transferred to the waste toner collecting device 60 through a waste toner tray 43 and a waste toner conveyer 45.

As shown in FIG. 1, the cleaning device 42 makes contact with a surface of the intermediate transfer body 33, and comprises a cleaning blade 42A which rakes off the waste toner remaining in the intermediate transfer body 33. An end part of the cleaning blade 42A may move in a predetermined distance. Thus, when the visible image on the photosensitive medium 31 is transferred onto the intermediate transfer body 33, the cleaning blade 42A is separated from the surface of the intermediate transfer body 33. After the visible image on the intermediate transfer body 33 is transferred onto the printable medium, the cleaning blade 42A makes contact with the surface of the intermediate transfer body 33 to remove the waste toner.

As shown in FIGS. 1 and 2, the waste toner removed by the cleaning device 42 is dropped onto the waste toner tray 43 having an auger 44. The auger 44 transfers the waste toner to the waste toner conveyer 45. One end of the waste toner conveyer 45 is placed inside the waste toner collecting device 60. The waste toner conveyer 45 has a conveyer belt 46 in the form of a caterpillar that transfers the waste toner to the waste toner collecting device 60. The auger 44 and the conveyer belt 46 are operated by a motor (not shown).

Figure 3:
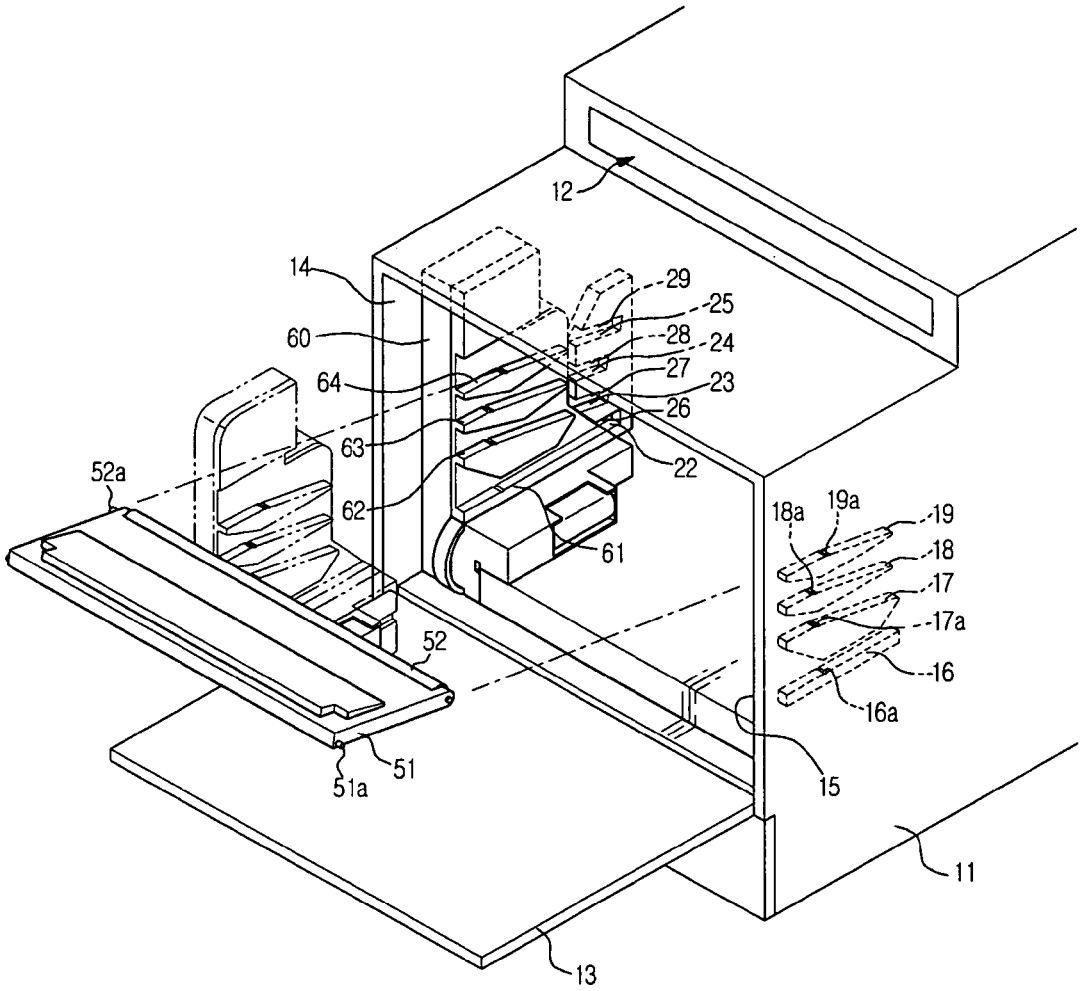
FIG. 3 is a schematic perspective view showing the main body of an image forming apparatus according to an embodiment of the present invention, in which a front cover of the main body is open.

As shown in FIGS. 2 and 3, the waste toner collecting device 60 has a reservoir (not shown) to store the waste toner therein, and has four supporting rails 61, 62, 63 and 64 at one side of an inner part thereof. The supporting rails 61, 62, 63 and 64 support four developing devices 51, 53, 55, and 57.

Figure 7:
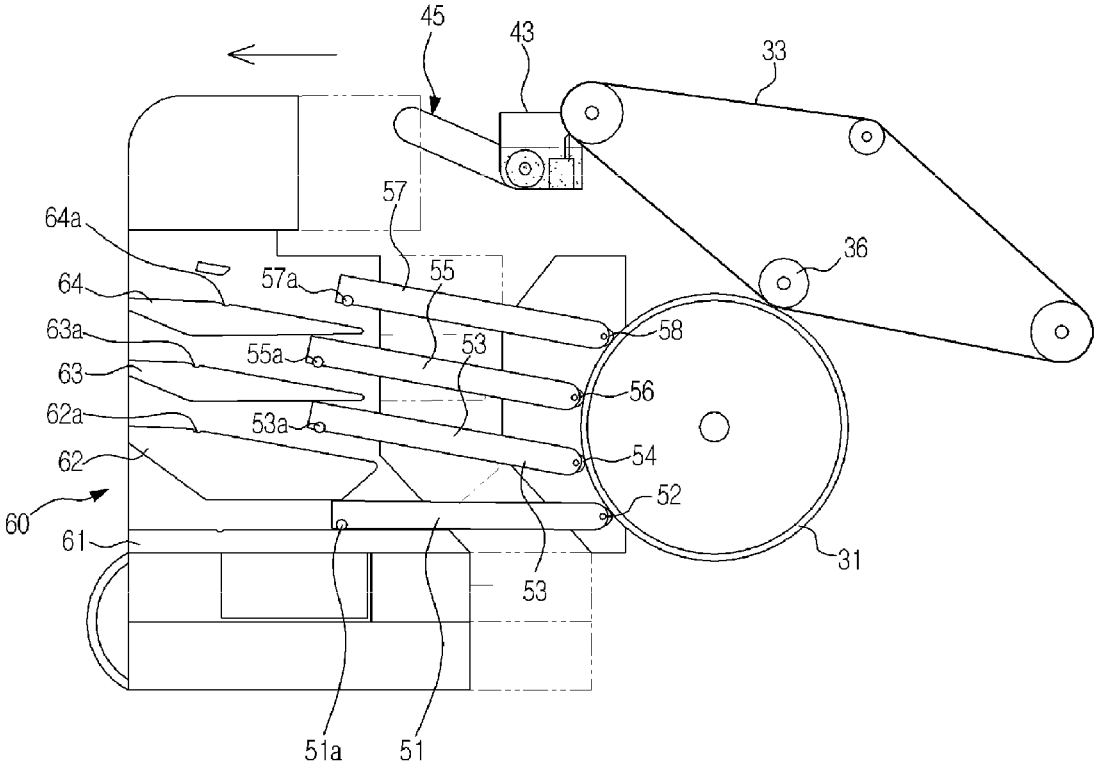

As shown in FIGS. 3 and 7, the developing devices 51, 53, 55, and 57 are detachably installed in the body 11 so as to apply the toners having various colors to the photosensitive medium 31. Developing rollers 52, 54, 56, and 58 for applying the toners to the photosensitive medium 31 are installed at a front part of the developing devices 51, 53, 55, and 57, respectively. Pairs of position fixing protrusions 51A, 53A, 55A, and 57A protrude from rear parts of the developing devices 51, 53, 55, and 57, respectively. The developing devices 51, 53, 55, and 57 are provided with terminals 52A, 54A, 56A, and 58A to supply the power.

The supporting rails 61, 62, 63, and 64 of the waste toner collecting device 60 are provided with position fixing grooves 61A, 62A, 63A, and 64A corresponding to the position fixing protrusions 51A, 53A, 55A, and 57A of the developing devices 51, 53, 55, and 57, respectively. When a user inserts the developing devices 51, 53, 55, and 57 along the supporting rails 61, 62, 63, and 64 of the waste toner collecting device 60, the position fixing protrusions 51A, 53A, 55A, and 57A of the developing devices 51, 53, 55, and 57 are inserted into the position fixing grooves 61A, 62A, 63A, and 64A of the supporting rails 61, 62, 63, and 64 so that the developing devices 51, 53, 55, and 57 can be fixed to a predetermined position.

As shown in FIG. 3, a plurality of inserting grooves 22, 23, 24, and 25 are provided at one inner side surface 14 of the body 11 and the other inner side surface 15 of the body 11 to receive side parts of front ends of the developing devices 51, 53, 55, and 57, on which the developing rollers 52, 54, 56 and 58 are provided. The front ends of the developing devices 51, 53, 55, and 57 are press-fitted into the inserting grooves 22, 23, 24, and 25, so that the developing devices 51, 53, 55, and 57 are rarely detached from the inserting grooves 22, 23, 24, and 25. The developing devices 51, 53, 55, and 57 installed at the predetermined position may be separated from the body only when the user pulls the developing devices 51, 53, 55, and 57 with a predetermined force. The inserting grooves 22, 23, 24, and 25 are provided with connectors 26, 27, 28, and 29 electrically connected to the terminals 52A, 54A, 56A, and 58A of the developing rollers 52, 54, 56, and 58 to supply the power. In addition, four mounting rails 16, 17, 18, and 19 corresponding to the supporting rails 61, 62, 63, and 64 of the waste toner collecting device 60 are provided at the inner side surface 15 of the body 11. The mounting rails 16, 17, 18, and 19 are also provided with the position fixing grooves 16A, 17A, 18A, and 19A into which the position fixing protrusions 51A, 53A, 55A, and 57A of the developing devices 51, 53, 55, and 57 are inserted.

The installing position of the position fixing protrusions 51A, 53A, 55A, and 57A for fixing the developing devices 51, 53, 55, and 57 may be interchangeable with the installing position of the position fixing grooves 16A, 17A, 18A, and 19A. The position fixing grooves can be installed at the developing devices 51, 53, 55, and 57, and the position fixing protrusions can be installed at the waste toner collecting device 60 and the body 11.

When the developing devices 51, 53, 55, and 57 are installed at the body 11, one side of each developing device 51, 53, 55, and 57 is supported by the supporting rails 61, 62, 63 and 64. The other side of each developing device 51, 53, 55, and 57 is supported by the mounting rails 16, 17, 18, and 19.

All of the supporting rails 61, 62, 63, and 64 and the mounting rails 16, 17, 18, and 19, may be slightly inclined except for the lowest supporting rail 61 and the mounting rail 16, so that three developing devices 53, 55, and 57 of the four developing devices 51, 53, 55, and 57 are inclined. Thus, all developing rollers 52, 54, 56, and 58 easily make contact with the photosensitive medium 31, so that the toners having various colors can be easily applied to the photosensitive medium 31 through the developing rollers 52, 54, 56 and 58.

The body 11 is provided with an installing space 21 (shown in FIG. 6) at an inner side thereof to install the waste toner collecting device 60. The waste toner collecting device 60 is detachably installed in the installing space 21. A front cover 13 is installed to be opened and closed at a front of the body 11, so the waste toner collecting device 60 and the developing devices 51, 53, 55 and 57 can be installed or detached after opening the front cover 13. A coupling groove 14A (see, FIG. 6) is provided at one inner side surface 14 of the body 11. The coupling groove 14A fixes the waste toner collecting device 60 to the predetermined position in the installing space 21.

Figure 5:
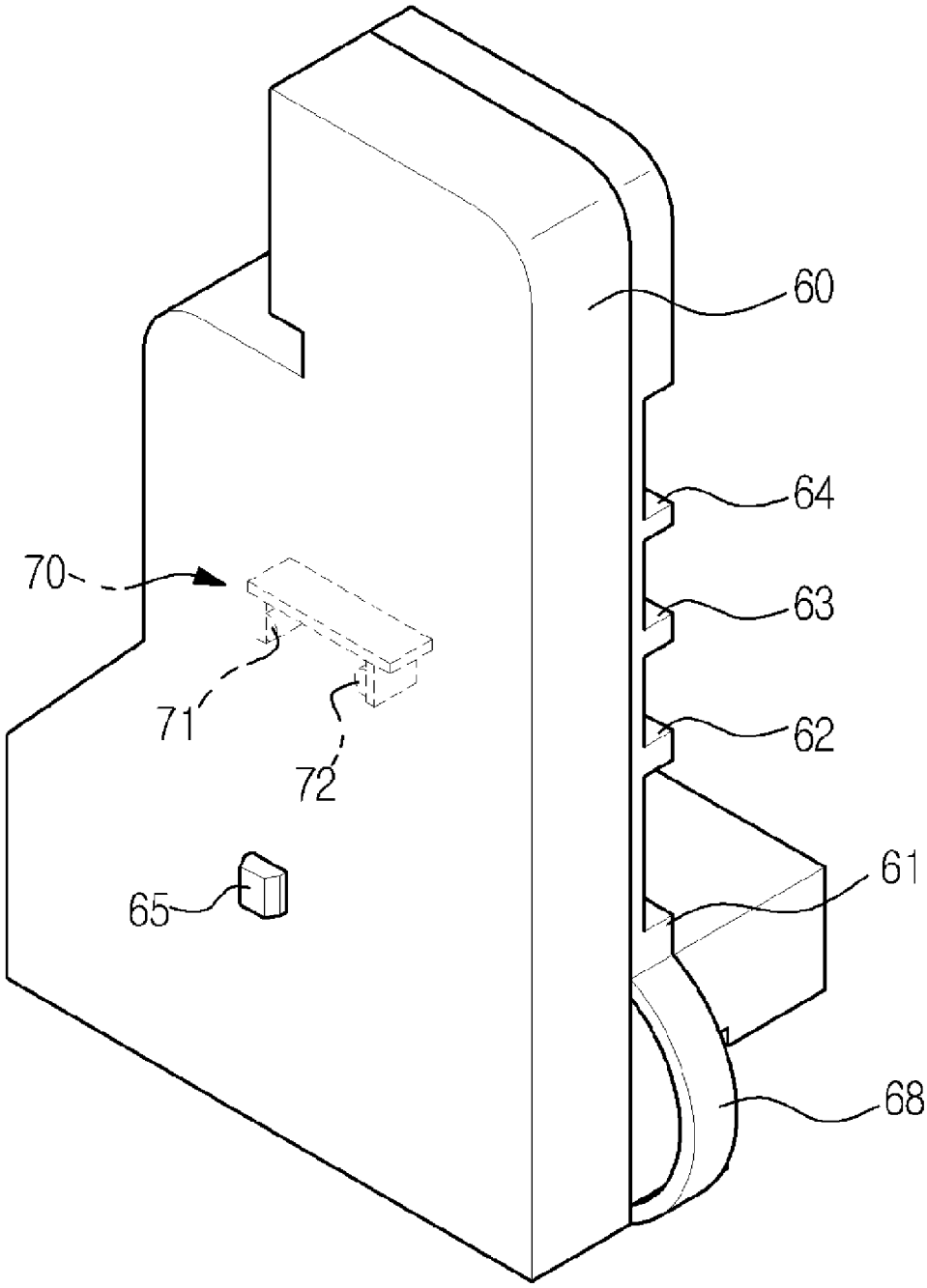

As shown in FIG. 5, a coupling protrusion 65 corresponding to the coupling groove 14A protrudes from an outer surface of the waste toner collecting device 60. When the waste toner collecting device 60 is pushed into the installing space 21, the coupling protrusion 65 is inserted into the coupling groove 14A such that the waste toner collecting device 60 can be fixed in the predetermined position. According to aspects of the present invention, the predetermined positions of the coupling groove 14A and the coupling protrusion 65 can be changed. The coupling groove 14A can be provided at the waste toner collecting device 60, and the coupling protrusion 65 can be provided at the body 11.

Figure 4:
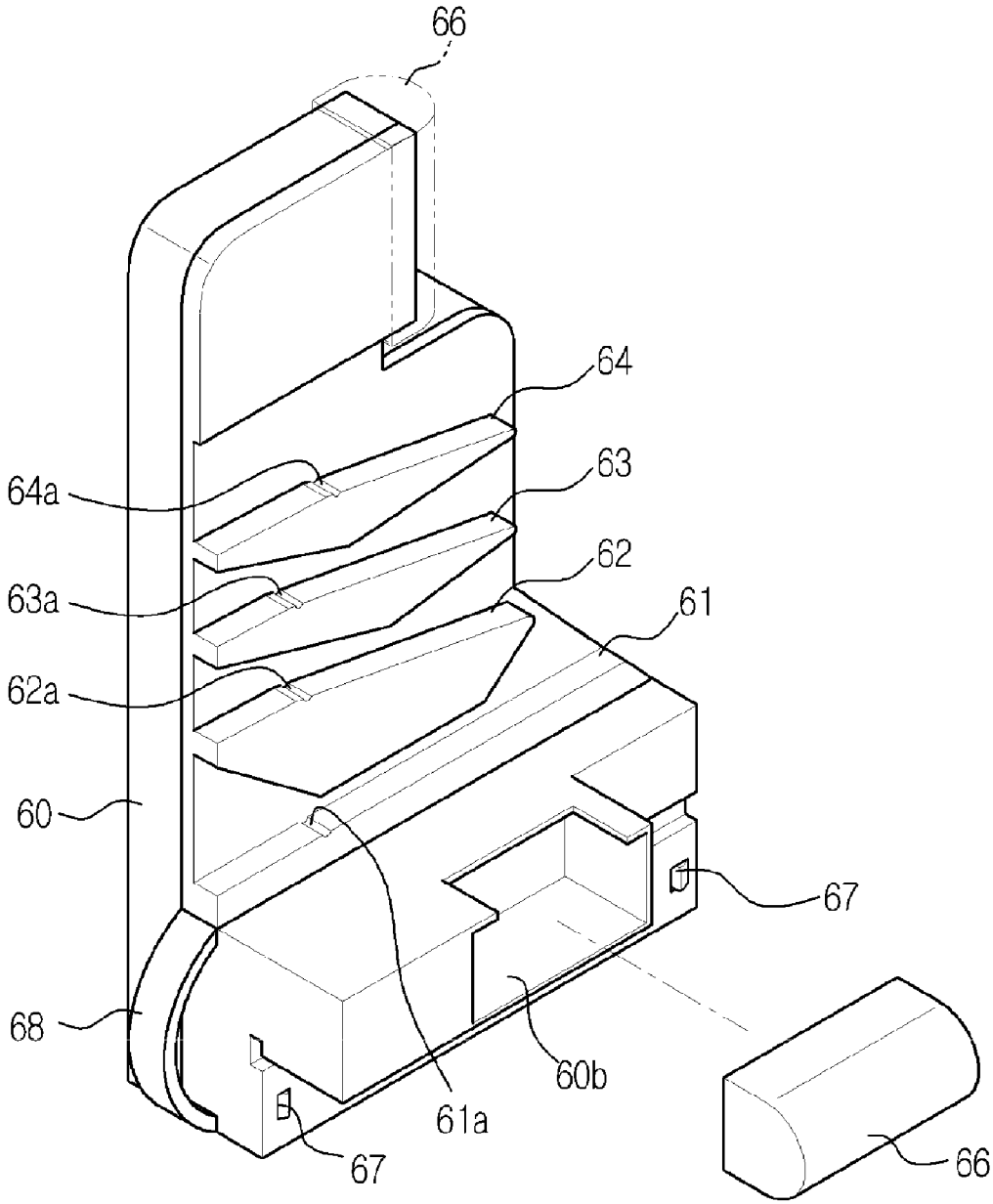
FIGS. 4 and 5 are perspective views schematically showing a waste toner collecting device of an image forming apparatus according to an embodiment of the present invention.

In addition, as shown in FIGS. 2, 4, and 5, the waste toner collecting device 60 comprises a waste toner inlet 60A having an opening so that the waste toner can be input, a protection cap 66 for protecting the waste toner inlet 60A, a cap receiving groove 60B that accommodates the protection cap 66, a pair of spacer protrusions 67 to separate the inner surface of the waste toner collecting device 60 from the body 11, a waste toner sensor 70 to sense the stored waste toner, and a handle 68 that enables the user to easily hold the waste toner collecting device.

The protection cap 66 blocks the waste toner inlet 60A when separating the waste toner collecting device 60 from the body 11, so the waste toner can be prevented from leaking. The protection cap 66 can be stored in the cap receiving groove 60B, so that the protection cap 66 can be conveniently stored when the waste toner collecting device 60 is installed in the installing space 21.

The pair of spacer protrusions 67 separate one side of the waste toner collecting device 60 from the body 11, so that the friction between the waste toner collecting device 60 and the body 11 is reduced when the waste toner collecting device 60 is installed or detached. Due to the spacer protrusions 67, the waste toner collecting device 60 can smoothly slide forward and backward in the installing space 21.

The waste toner sensor 70 may be an optical sensor including a light emitting unit 71 to generate light and a light receiving unit 72 to sense the light generated from the light emitting unit 71. If the waste toner accumulates to more than a predetermined height, the light from the light emitting unit 71 is blocked by the waste toner, so the strength of the light incident onto the light receiving unit 72 becomes weak. When the strength of the light incident onto the light receiving unit 72 changes, the waste toner sensor 70 transmits a sensed signal to a controller (not shown), so the user can recognize the cleaning and exchanging time of the waste toner collecting device 60 without taking out the waste toner collecting device 60.

In the image forming apparatus 100, the supporting rails 61, 62, 63, and 64, which can support one side of the developing devices 51, 53, 55, and 57, are provided at the waste toner collecting device 60 detachably installed at one inner side of the body 11, so that the mounting rails 16, 17, 18, and 19 for supporting the developing devices 51, 53, 55, and 57 can be installed at the inner side surface 15 of the body 11. Mounting rails at the opposing inner side surface 14 of the body 11 can be omitted. The installing space in the body 11 is thus reduced, so that the width of the body 11 can be reduced.

As shown in FIG. 3, the waste toner collecting device 60 is installed in the installing space 21 of the body 11, and the developing devices 51, 53, 55, and 57 are sequentially installed at the predetermined position. The front end parts of the developing devices 51, 53, 55, and 57 are press-fitted into the inserting grooves 22, 23, 24, and 25 of the body 11, and pairs of the position fixing protrusions 51A, 53A, 55A, and 57A provided at both inner sides of the body 11 are inserted into the position fixing grooves 16A, 17A, 18A, and 19A of the mounting rails 16, 17, 18, and 19 and the position fixing grooves 61A, 62A, 63A, and 64A of the supporting rails 61, 62, 63, and 64, so the developing devices 51, 53, 55, and 57 are fixed at predetermined positions where the toner can be applied to the photosensitive medium 31.

Figure 6:
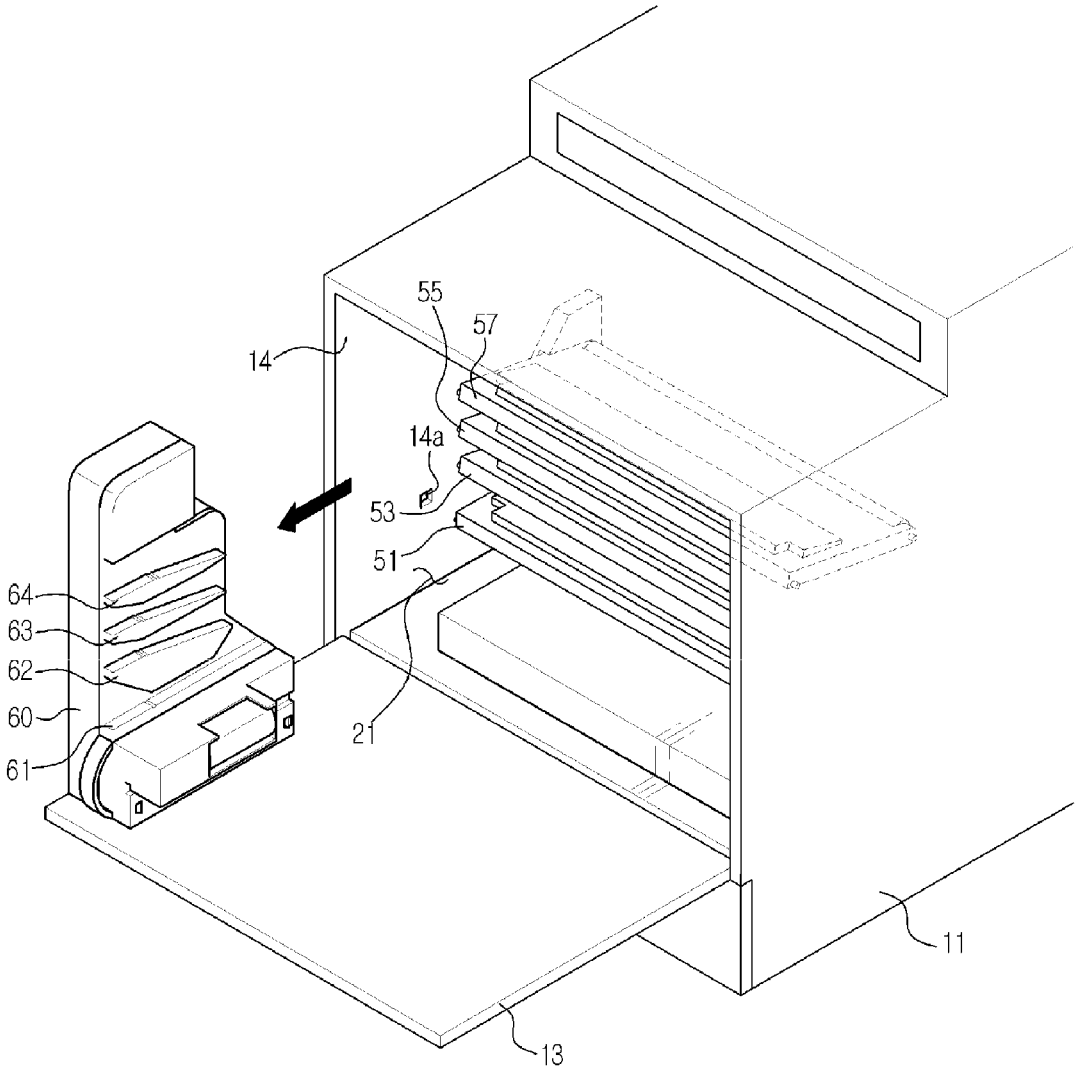
FIGS. 6 and 7 are a perspective view and a side sectional view, respectively, showing the procedure of separating a waste toner collecting device from the main body of an image forming apparatus according to an embodiment of the present invention.

When the developing devices 51, 53, 55, and 57 are fixed at the predetermined position, the front end parts of the developing devices 51, 53, 55, and 57 are not easily separated from the inserting grooves 22, 23, 24, and 25. As shown in FIGS. 6 and 7, even if the waste toner collecting device 60 is separated from the body 11, the developing devices 51, 53, 55, and 57 are maintained in the predetermined position. When the user pulls the waste toner collecting device 60 from the body 11 using the handle 68, the supporting rails 61, 62, 63, and 64 do not interfere with the developing devices 51, 53, 55, and 57, so the waste toner collecting device 60 can be easily separated from the body 11. Moreover, a cleaned waste toner collecting device 60 or a new waste toner collecting device 60 can be installed in the installing space 21 even though the developing devices 51, 53, 55, and 57 are installed. In this manner, the waste toner collecting device 60 can be easily installed and detached without interfering with the developing devices 51, 53, 55, and 57 while supporting the developing devices 51, 53, 55, and 57.

Figure 8:
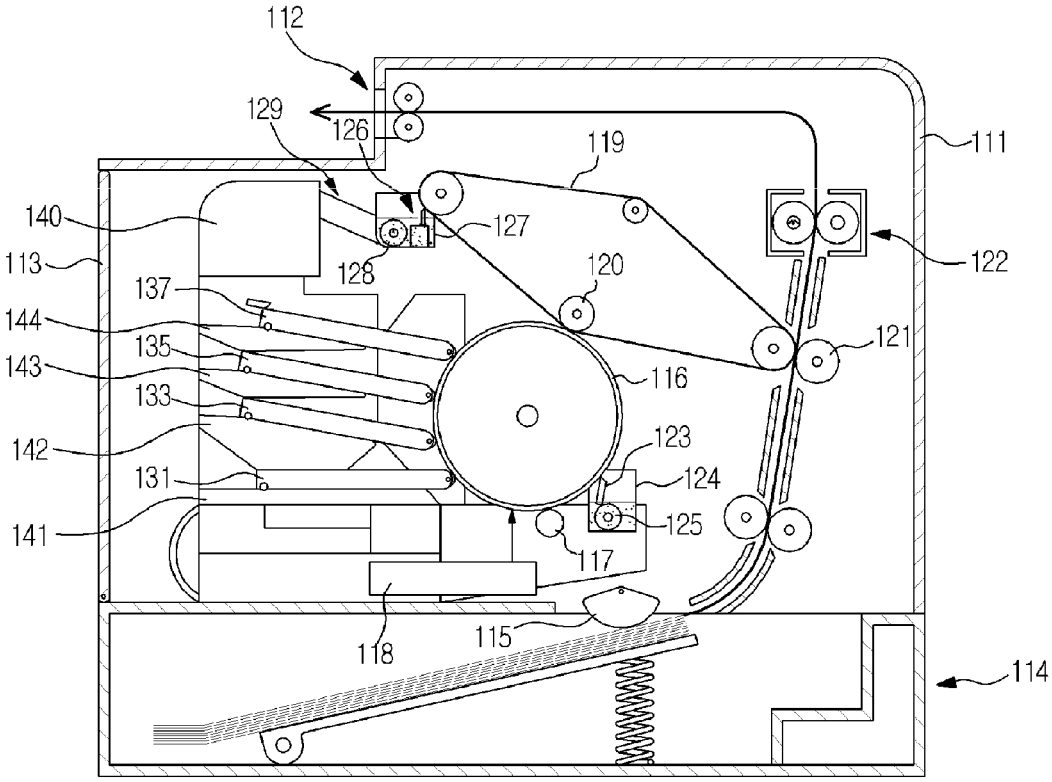
FIG. 8 is a schematic side sectional view showing an image forming apparatus according to another embodiment of the present invention.

FIG. 8 is a schematic side sectional view showing an image forming apparatus 200 according to another embodiment of the present invention. Most components of the image forming apparatus 200 are similar to those of the image forming apparatus 100. However, a waste toner collecting device 140 is designed to collect a waste toner removed from a photosensitive medium 116 and a waste toner separated from an intermediate transfer body 119. The image forming apparatus 200 comprises a body 111 having an outlet 112 and a front cover 113, a printable medium supplier 114 which supplies a printable medium (such as paper, transparent film, thermal paper, and the like), a photosensitive medium 116, a charging device 117, an exposure unit 118, the intermediate transfer body 119, first and second transfer devices 120 and 121, a first cleaning device 123 to remove the waste toner remaining in the photosensitive medium 116, a second cleaning device 126 to remove the waste toner remaining in the intermediate transfer body 119, a plurality of developing devices 131, 133, 135, and 137, and the waste toner collecting device 140.

The waste toner collecting device 140 is detachably installed at one inner side of the body 111, and has a plurality of supporting rails 141, 142, 143, and 144 to support the developing devices 131, 133, 135, and 137. The waste toner removed from the photosensitive medium 116 by the first cleaning device 123 is dropped onto a first waste toner tray 124, and then transferred to the waste toner collecting device 140 by a first auger 125. The waste toner removed from the intermediate transfer body 119 by the second cleaning device 126 is dropped onto a second waste toner tray 127, and then transferred to the waste toner collecting device 140 by a second auger 128 and a waste toner conveyer 129. Other components are similar to those of the image forming apparatus 100.

In the image forming apparatus 200, the supporting rails 141, 142, 143, and 144, which can support the developing devices 131, 133, 135, and 137, are provided at the waste toner collecting device 140, so the components (mounting rails) for supporting the developing devices 131, 133, 135, and 137 can be omitted at one inner side surface of the body 111. Thus, the width of the body 111 can be reduced.

Although an indirect color laser printer having four developing devices has been described above as the image forming apparatus, the image forming apparatus according to aspects of the present invention may comprise various numbers of the developing devices and a direct image forming apparatus.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a photosensitive medium on which an electrostatic latent image is formed;

a developing device to apply toner to the photosensitive medium a cleaning device to remove waste toner remaining on the photosensitive medium; and a waste toner collecting device to store the waste toner removed from the photosensitive medium and having a supporting rail to support the developing device or to guide mounting of the developing device.

2. The image forming apparatus of claim 1, further comprising:

a body that forms an outer appearance of the image forming apparatus;

wherein an installing space is provided at a first inner side of the body, and the waste toner collecting device is detachably installed at the installing space.

3. The image forming apparatus of claim 2, further comprising:

a mounting rail disposed at a second inner side of the body to support the developing device;

wherein one side of the developing device is supported by the supporting rail and another side of the developing device is supported by the mounting rail.

4. The image forming apparatus of claim 3, further comprising:

an inserting groove provided in the body into which a front end part of the developing device is inserted;

wherein the front end part of the developing device is not separated from the inserting groove even if the waste toner collecting device is separated from the installing space; and one side of the developing device is supported by the mounting rail such that the developing device maintains a fixed position.

5. The image forming apparatus of claim 2, further comprising:

a coupling groove provided at an inner side surface of the body or provided at a side surface of the waste toner collecting device; and a coupling protrusion inserted into the coupling groove and provided at the other of the body and the side surface to fix the waste toner collecting device to a predetermined position of the installing space.

6. The image forming apparatus of claim 5, further comprising a spacer protrusion protruding from the waste toner collecting device or from the body to separate the waste toner collecting device from the body.

7. The image forming apparatus of claim 1, further comprising:

a position fixing groove provided at one of the supporting rail and the developing device; and a position fixing protrusion inserted into the position fixing groove provided at the other of the supporting rail and the developing device to fix the developing device to a predetermined position of a body of the image forming apparatus.

8. The image forming apparatus of claim 1, wherein the waste toner collecting device comprises:

a waste toner inlet into which the waste toner is input; and a protection cap to open and close the waste toner inlet.

9. The image forming apparatus of claim 8, wherein the waste toner collecting device comprises a cap receiving groove to accommodate the protection cap.

10. An image forming apparatus comprising:

a photosensitive medium on which an electrostatic latent image is formed;

a plurality of developing devices to apply a toner to the photosensitive medium an intermediate transfer body to transfer visible images formed on the photosensitive medium to a printable medium;

a cleaning device to remove a waste toner remaining on the intermediate transfer body; and a waste toner collecting device to store the waste toner removed from the intermediate transfer body, and having a plurality of supporting rails to support the developing devices or to guide mounting of the developing device.

11. The image forming apparatus of claim 10, further comprising:

a body that forms an outer appearance of the image forming apparatus; and an installing space provided at a first inner side of the body;

wherein the waste toner collecting device is detachably installed at the installing space.

12. The image forming apparatus of claim 11, further comprising:

a plurality of mounting rails provided at a second inner side of the body to support the developing devices;

wherein each side of each developing device is supported by one of the supporting rails or one of the mounting rails.

13. The image forming apparatus of claim 12, further comprising:

a plurality of inserting grooves provided in the body into which front end parts of the developing devices;

wherein the front end parts of the developing devices are not separated from the inserting grooves even if the waste toner collecting device is separated from the installing space, and one side of the developing devices is supported by the mounting rails such that the developing devices maintain a fixed position.

14. The image forming apparatus of claim 11, further comprising:

a position fixing groove provided at one of an inner side surface of the body and a side surface of the waste toner collecting device; and a position fixing protrusion inserted into the position fixing groove and provided at a remaining one of the body and the side surface to fix the waste toner collecting device to a predetermined position of the installing space.

15. The image forming apparatus of claim 14, further comprising a spacer protrusion protruding from the waste toner collecting device or from the body to separate the waste toner collecting device from the body.

16. The image forming apparatus of claim 10, further comprising:

a position fixing groove provided at the supporting rails or provided at the developing devices; and a position fixing protrusion inserted into the position fixing groove and provided at the other of the supporting rail and the developing device to fix the developing devices to a predetermined position of a body of the image forming apparatus.

17. The image forming apparatus of claim 10, wherein the waste toner collecting device comprises:

a waste toner inlet into which the waste toner is input; and a protection cap to open and close the waste toner inlet.

18. The image forming apparatus of claim 17, wherein the waste toner collecting device comprises a cap receiving groove to accommodate the protection cap.

19. The image forming apparatus of claim 10, wherein at least one of the supporting rails is inclined.

20. An image forming apparatus to form an image onto a printable medium, the image forming apparatus comprising:

at least one developing device;

an image transfer body to transfer toner images formed on a photosensitive medium to the printable medium; and a waste toner collecting device to collect waste toner from the image transfer body or the photosensitive medium and having at least one supporting rail, each of the at least one supporting rails supporting or guiding one of the at least one developing device.

21. The image forming apparatus of claim 20, wherein each developing device is supported by only one mounting rail.

22. The image forming apparatus according to claim 20, wherein the at least one supporting rail is integrally formed with the waste toner collecting device.

23. A developing device, which is detachably mountable in an image forming apparatus having an inserting groove and a waste toner collecting device provided with a supporting rail, the developing device comprising:

a cartridge body having a front portion provided with a side part adapted to be press-fitted into the inserting groove of the image forming apparatus, when the developing device is mounted in the image forming apparatus via the supporting rail of the waste toner collecting device;

a developing roller rotatably mounted to the cartridge body; and a terminal positioned on the cartridge body such that the terminal establishes an electrical connection with an electrical connector provided on the inserting groove, when the developing device is mounted in the image forming apparatus.

24. The developing device of claim 23, wherein a first side of the cartridge body is supported by the supporting rail of the waste toner collecting device and a second side of the cartridge body is supported by a mounting rail provided at the image forming device.

25. The developing device of claim 23, wherein the developing device is supported by the supporting rail of the waste toner collecting device while being inclined relative to a horizontal direction.

26. The developing device of claim 23, further comprising a position determining unit which is coupled to the waste toner collecting device.

27. The developing device of claim 23, wherein the developing device is detachably attached to the image forming apparatus independently from the waste toner collecting device.

* * * * *

UNITED STATES PATENT AND TRADEMARK OFFICE

CERTIFICATE OF CORRECTION

PATENT NO. : 7,865,123 B2
APPLICATION NO. : 12/109480
DATED : January 4, 2011
INVENTOR(S) : Myoung Sub Jang et al.

It is certified that error appears in the above-identified patent and that said Letters Patent is hereby corrected as shown below:

Column 9, Line 67, In Claim 1, after “medium” insert --;--.

Column 10, Line 64, In Claim 10, after “medium” insert --;--.

Signed and Sealed this
Nineteenth Day of April, 2011

David J. Kappos

David J. Kappos
*Director of the United States Patent and Trademark Office*